US006179289B1

(12) United States Patent
Matsushita et al.

(10) Patent No.: US 6,179,289 B1
(45) Date of Patent: Jan. 30, 2001

(54) PAPER-FEED CONTROL UNIT AND METHOD OF CONTROL FOR IMAGE-FORMING APPARATUS

(75) Inventors: Yusuke Matsushita; Hisanobu Matsuzoe; Shinichiro Tsunematsu; Tetsuya Adachi; Koji Migita, all of Fukuoka; Susumu Uemura, Saga; Koichi Umeno, Fukuoka; Masanori Goto, Fukuoka; Yukinori Hara, Fukuoka, all of (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/218,479

(22) Filed: Dec. 22, 1998

(30) Foreign Application Priority Data

Jan. 22, 1998 (JP) ..... 10-010205

(51) Int. Cl.[7] ..... B65H 5/12
(52) U.S. Cl. ..... 271/266
(58) Field of Search ..... 271/266, 264, 271/3.14, 3.2, 272; 347/153, 158, 149; 399/388, 389

(56) References Cited

U.S. PATENT DOCUMENTS 6,017,160 * 1/2000 Sato et al. ..... 271/266 X

FOREIGN PATENT DOCUMENTS 9-230715 9/1997 (JP) .

* cited by examiner

*Primary Examiner*—David H. Bollinger
(74) *Attorney, Agent, or Firm*—Ratner & Prestia

(57) ABSTRACT

Paper-feed control of an image-forming apparatus, in which the control unit has a paper-feed-motor-drive-controller for controlling a paper-feed-motor. The paper-feed-motor rotating a resist roller and a paper ejection-roller for feeding printing paper. The paper-feed-motor is controlled to perform a plurality of paper-feeds of predetermined width on a sheet of printing paper. An image is formed on the sheet of printing paper after respective paper-feed. The paper-feed-motor is controlled by the paper-feed-motor-controller to perform the paper-feed such that the end of the printing paper remains in contact with the resist roller from which the end of the paper leaves after the final paper-feed.

8 Claims, 6 Drawing Sheets

100b
100a
100
8
10
20
12
9
6
7
A
P

12
P
B1=P

12
P
P
B1=P
P-W
P
P
P
12

X
W
C1
X+W
LS
LP
12b
12a 100b
100a
100
8
10
20

12
9
6
7
A
P

12
P
B1=P

12
P
P
B1=P
12

W
P
P
B1=P
LL
LP
12b
12a

PAPER-FEED CONTROL UNIT AND METHOD OF CONTROL FOR IMAGE-FORMING APPARATUS

FIELD OF THE INVENTION

The present invention relates to a paper-feed control unit and the method of control for an image-forming apparatus. In particular, when forming an image on printing paper the feeding of a sheet of printing paper is performed by a resist roller and a paper-ejection-roller of an image-forming apparatus controlled by a paper-feed control unit.

BACKGROUND OF THE INVENTION

In a serial printing apparatus such as, for example, a dot printer, an ink-jet printer or the like, an image is formed on a sheet of printing paper by printing an image having a predetermined width a plurality of times on the paper. Therefore, the feeding of paper at intervals corresponding to the predetermined width should be performed with relative precision.

FIG. 6 is a block diagram showing a paper-feed control unit of a conventional image-forming apparatus. FIGS. 4A through 4D illustrate the operation of a paper-feed control unit of an orthogonal-transfer-type image-forming apparatus disclosed in the Japanese Patent Application Laid Open No. H09-230715, in which a toner image is transferred in an orthogonal direction to the paper feeding direction.

In FIG. 6, a printing controller 2 controls a transfer controller 3 for controlling image transfer, and a paper-feed-motor-drive-controller 4. The paper-feed-motor-drive-controller 4 controls the drive of a paper-feed-motor 5. The paper-feed-motor 5 causes resist roller 6 and paper-ejection-roller 7 to rotate. The components shown in FIG. 6, with the exception of transfer controller 3, comprise the paper-feed control unit.

In FIG. 4A, resist roller 6 is disposed upstream of toner image carrier 100 (the paper feeding direction shown by arrow 20) and paper-ejection-roller 7 is disposed downstream of toner image carrier 100. In toner image carrier 100, a toner image is formed corresponding to inputted image data. Transfer-facing-roller 8 performs printing by transferring a toner image, formed in the toner image carrier 100, to a sheet of printing paper 12 by rotating and moving in a direction orthogonal to paper feeding direction 20. As shown in FIG. 2A, printing area P is an area between right end 100*a* (end at downstream side of paper feeding direction) and left end 100*b* (end of upstream side of toner image carrier 100) of toner image carrier 100. A transfer plate 9 is pressed by transfer-facing-roller 8 through toner image carrier 100 and printing paper 12. Resist-pinch-roller 10 faces resist roller 6. An explanation of the structure and operation of a chassis supporting transfer plate 9, etc. is omitted. In FIG. 4D, LP represents the length of printing paper 12 in paper feeding direction 20, 12*a* represents the front end of printing paper 12 of the downstream side of paper feeding direction 20, 12*b* represents the back end (final end) of the upstream side of paper feeding direction 20, and "A" represents the dimension from resist roller 6 to left end 100*b* of toner carrier 100 as shown in FIG. 4A.

FIG. 5 is a flow chart showing an operation of a paper-feed control unit of a conventional image-forming apparatus. The operation is described below referring to FIG. 4A through FIG. 4D, FIG. 5, and FIG. 6.

First, paper-feed-motor-drive-controller 4 rotates paper-feed-motor 5 by an A-step (S21). For paper-feed-motor 5, a stepping motor may be used. Following an A-step rotation of paper-feed-motor 5, front end 12*a* of the printing paper reaches to substantially the same position as that of right end 100*a* of printing area P of toner image carrier 100. Then, a first transfer is performed (S22) on first printing area P.

Next, paper-feed-motor 5 rotates by a B-step (S23) feeding printing paper 12 by paper-feed-dimension B1. Dimension B1 is equal to the width of first printing area P as shown in FIG. 4B. FIG. 4B through FIG. 4D show the relative movement from the position in FIG. 4A of printing paper 12. In step S24, a second transfer is performed on second printing area P.

Then, paper-feed-motor 5 rotates again by a B-step (S25) for feeding printing paper 12 by a paper-feed-dimension B1. In step S26, a third transfer is performed on third printing area P.

Further, paper-feed-motor 5 rotates by B-step (S27) for feeding printing paper 12 by a paper-feed-dimension B1, and as shown in FIG. 4D, a fourth transfer is performed (S28) on forth printing area W (final printing area). After final printing, the printing paper is ejected (S29).

As shown in FIG. 4D, in the paper-feed control unit of the above conventional image-forming apparatus, because the paper-feed-dimension after the third printing is B1, back end 12*b* of printing paper 12 arrives at a position displaced by a dimension LL from resist roller 6. In FIG. 4, LL>A, and a paper-feed of dimension LL is performed by paper-ejection-roller 7. Due to the dispersion of the diameter of the roller of paper-ejection-roller 7, however, the paper-feed-dimension may not be accurately B1, and may differ from the paper-feed dimension traversed by resist roller 6, by which the quality of the transferred image may deteriorate. Therefore, it is desirable to make the dimension of paper-feed traversed by a paper-ejection-roller as short as possible.

SUMMARY OF THE INVENTION

The present invention aims to provide a paper-feed control unit and a method of controlling an image-forming apparatus which may result in an improvement to the quality of a transferred image.

A controlled image-forming apparatus in accordance with the present invention includes: a resist roller, for feeding a sheet of printing paper; a paper-ejection-roller disposed at the downstream side of the resist roller in the paper feeding direction; an image-forming unit, disposed between the resist roller and the paper-ejection-roller for forming an image of predetermined width; a motor for rotating the resist roller and the paper-ejection-roller; and a motor-drive-controller for controlling said motor. The motor is controlled to feed printing paper of a dimension narrower than the predetermined width when the dimension of the upstream-side-printing-paper-area, on which image-forming has not yet been performed by the image-forming unit, becomes narrower than the predetermined width. The motor is also controlled to perform paper-feed of the predetermined width a plurality of times, and at least one paper-feed of a width narrower than the predetermined width. The image-forming unit performs image-forming on the printing paper.

By the above control, the dimension between the back end of the printing paper and the resist roller may be shortened. Hence, the paper-feed may be performed precisely, by which the quality of the transferred image may be improved.

DESCRIPTION OF THE PREFERRED EMBODIMENT

Hereinafter an exemplary embodiment of the present invention is described referring to illustrations. The structure of a paper-feed control unit of an image-forming apparatus in accordance with an exemplary embodiment is described below.

Figures 2A, 2B, 2C, 2D:
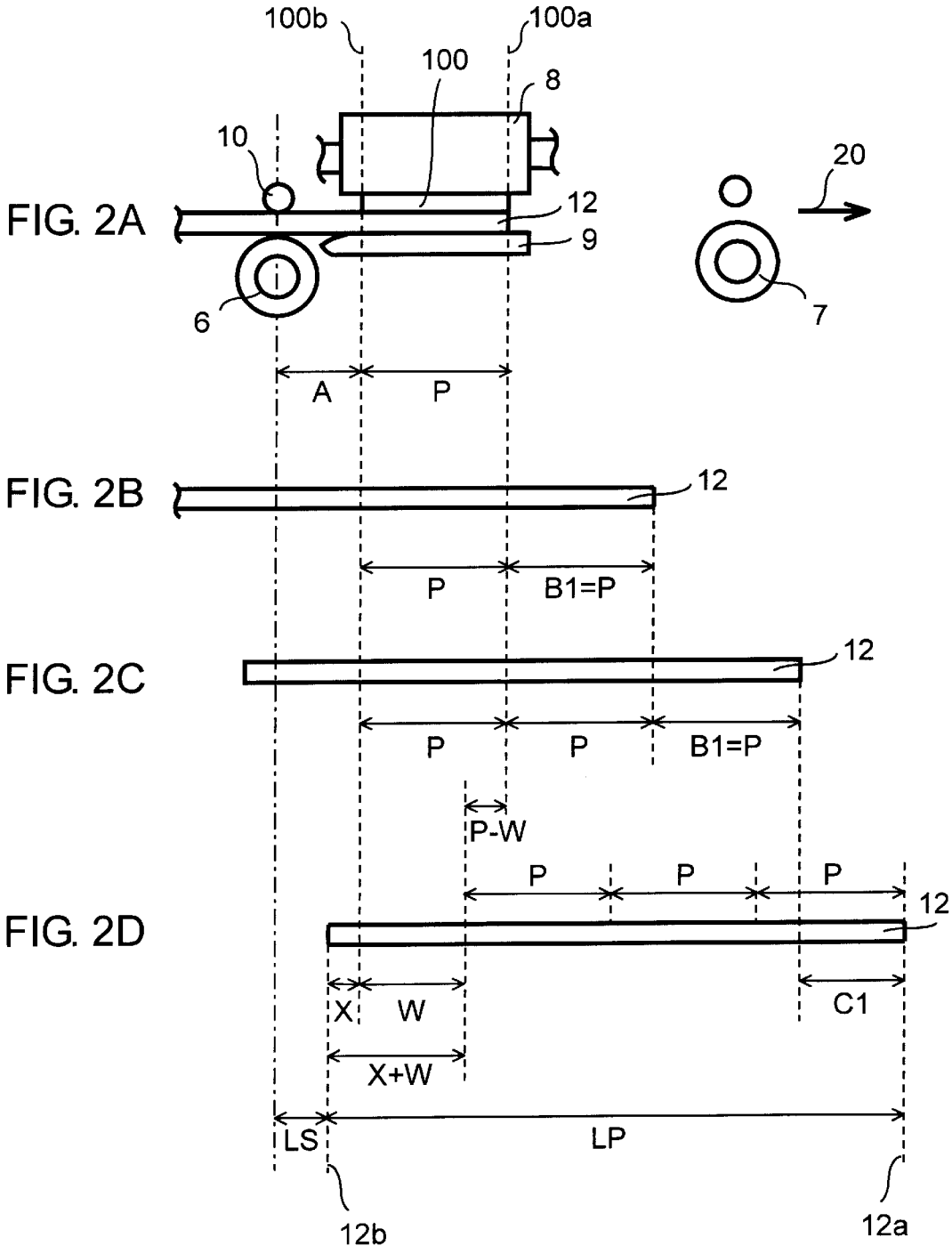
FIG. 2A through FIG. 2D show the structure of a paper-feed mechanism helpful in understanding the paper-feed of a paper-feed control unit of an image-forming apparatus of an exemplary embodiment of the present invention.
Figures 4A, 4B, 4C, 4D:
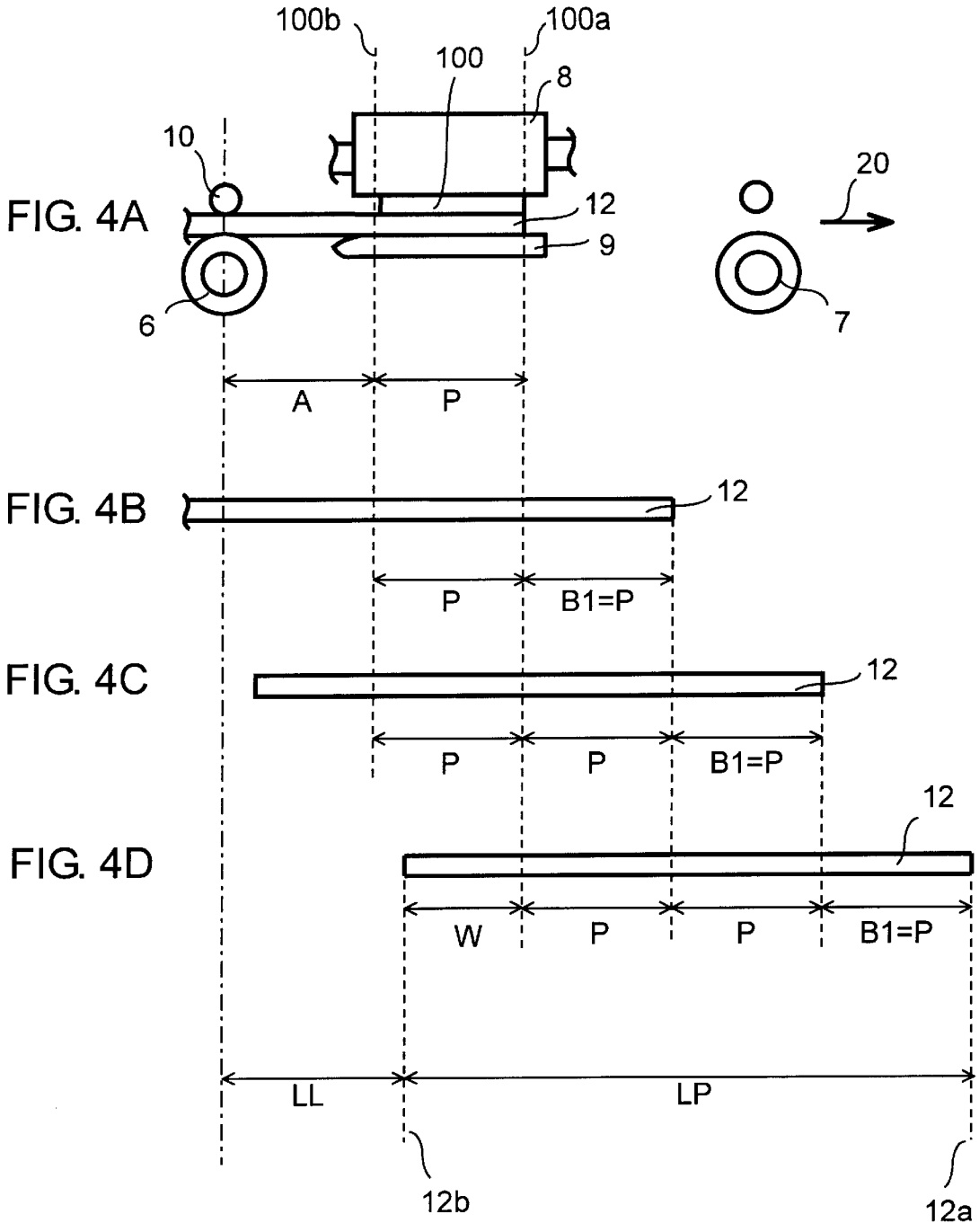
FIG. 4A through FIG. 4D show the structure of a paper-feed mechanism helpful in understanding the paper-feed of a paper-feed control unit of a conventional image-forming apparatus.

In FIG. 2A, resist roller 6 is disposed upstream of toner image carrier 100, and paper ejection roller 7 is disposed downstream of toner image carrier 100. In toner image carrier 100, a toner image may be formed corresponding to image data fed from outside. Transfer-facing-roller 8 performs printing by transferring an image formed in toner image carrier 100 onto printing paper 12 by rotating and moving in an orthogonal direction to a feeding direction of the paper 12, and by pressing toner image carrier 100 onto the paper 12. The printing area by toner image carrier 100 is area P between the upstream side end 100*b* and the downstream side end 100*a* of the paper feeding direction. Transfer plate 9 may be pressed by transfer-facing-roller 8. Resist-pinch-roller 10 faces resist roller 6. An image may thus be printed on the printing paper 12. As shown in FIG. 2D, 12*a* represents the front end of paper 12, 12*b* represents the back end of paper 12, and LP represents the length of paper 12. The dimension between resist roller 6 and upstream side end 100*b* of toner image carrier 100 is represented by "A" as shown in FIG. 4A.

The operation of a paper-feed control unit of an image-forming apparatus having a structure as described above is described hereinafter referring to FIG. 1, FIG. 2A through FIG. 2D, and FIG. 3.

Figure 3:
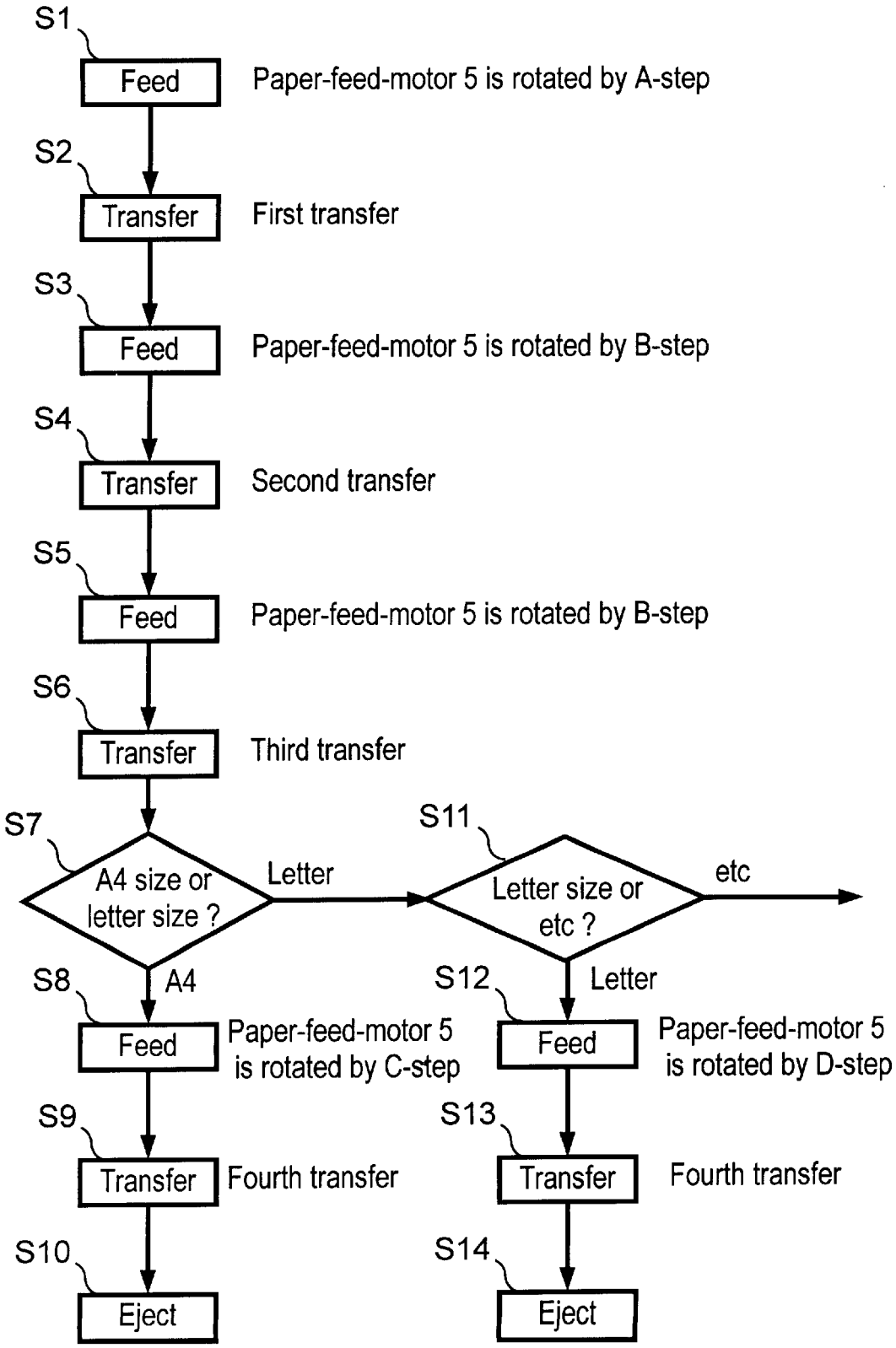
FIG. 3 is a flow chart showing the operation of a paper-feed control unit of an image-forming apparatus of an exemplary embodiment of the present invention.

First, as given in FIG. 3, paper-feed-motor 5 may be rotated by A-(step S1) so that the front end 12*a* of printing paper 12 comes to position 100*a* of the printing area P of toner image carrier 100 (shown in FIG. 2A). The printing paper 12 may be moved by a dimension of printing area P and additionally the dimension near the front end 12*a* of the paper 12. Then a first transfer may be performed (S2) on first printing area P. The dimension of a non-printing area near front end 12*a* of paper 12 may be adjusted by changing the paper-feed-dimension of paper 12.

Next, the paper-feed-motor is rotated by a B-step for feeding the printing paper by paper-feed-dimension B1 (S3 in FIG. 3). Paper-feed-dimension B1 may correspond to printing area P as shown in FIG. 4B. In the same manner as in a first printing, a second transfer may be performed (S4 in FIG. 3) on second printing area P.

Then, paper-feed-motor-drive-controller 4 rotates paper-feed-motor 5 by another B-step for feeding the printing paper by a paper-feed-dimension B1 (S5 in FIG. 3). Further, as shown in FIG. 2C, a third transfer is performed (S6 in FIG. 3) on third printing area P. At this time, the area from the left end 100*b* of the printing area P to back end 12*b* of the printing paper 12 is an area on which a transfer has not yet been performed.

Figure 1:
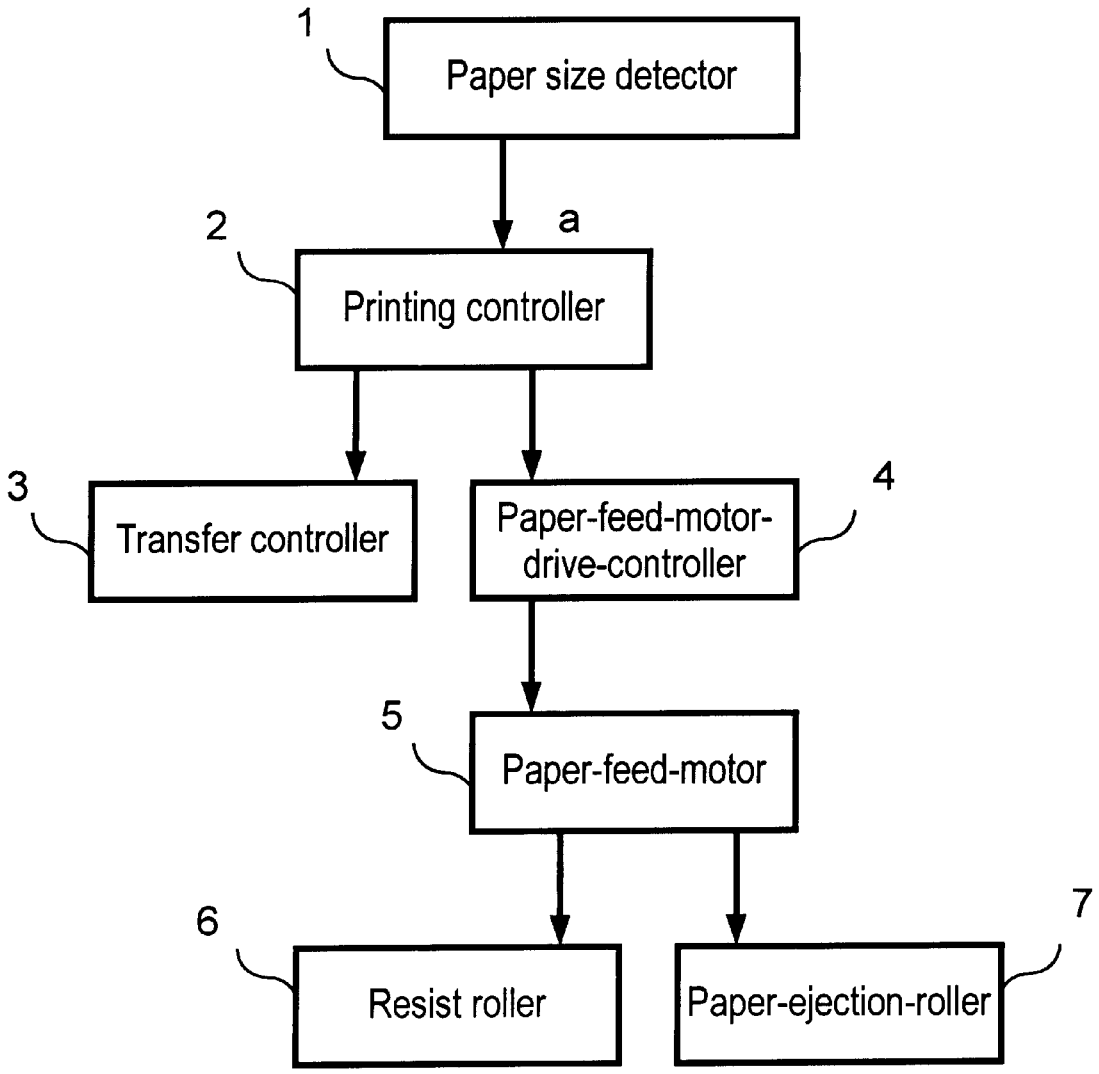
FIG. 1 is a block diagram showing a paper-feed control unit of an image-forming apparatus of an exemplary embodiment of the present invention.

Then, printing controller 2 detects (S7 in FIG. 3) the size of the printing paper based on a paper size signal "a" fed by paper size detector 1 of FIG. 1. The result of paper size detection may be provided to paper-feed-motor-drive-controller 4. When printing controller 2 determines the size of the paper to be, for example, A4 size, it proceeds to the next step (S8 in FIG. 3), and paper-feed-motor-drive-controller 4 rotates paper-feed-motor 5 by a C-step. Suppose that the area where the transfer has not yet been performed is narrower than printing area P. The value C as in the C-step may be computed so that a dimension X is an appropriate dimension, wherein X is a dimension from left end 100*b* of printing area P of toner image carrier 100 to back end 12*b* of printing paper 12. For instance, if X=0, back end 12*b* of printing paper 12 arrives at left end position 100*b* of printing area P of toner image carrier 100, so that the printing may be performed on printing paper 12 substantially without leaving non-printing area. While, if X>0, back end 12*b* of printing paper 12 stays to the left of left end 100*b* of printing area P of toner image carrier 100, which means that back end 12*b* of printing paper 12 remains at a position contacting the resist roller, whereby a final paper-feed may be made precisely. Then, on a forth printing area W (a final printing area) in FIG. 2D, a fourth printing is performed (S9 in FIG. 3). Fourth printing area is narrower than printing area P by a dimension of (P−W), which means that the printable area P of toner image carrier 100 may be wider than printing area W. Therefore, it may be necessary to restrict the image-forming area in toner image carrier 100 to a size corresponding to area W in order to prevent overlapped printing on area of (P−W) on which a third printing had already been performed. After a final printing, the printing paper may be ejected (S10 in FIG. 3).

It may be important to note that, as understood from a comparison between FIG. 2D and FIG. 4D, a paper-feed-dimension C1 of FIG. 2D after a third printing is narrower than a paper-feed-dimension B1 of FIG. 4D after a third printing. Accordingly a dimension (separation dimension) LS of FIG. 2D between back end 12*b* of the printing paper 12 and resist roller 6 may be made narrower than a separation dimension LL of FIG. 4D. As shown in FIG. 2A and FIG. 2D, LS<A, while, as shown in FIG. 4 of the conventional example, LL>A. Accordingly, LS<LL. Therefore, an image-forming area in printing area P of toner image carrier 100 may be restricted to the left part of the toner image carrier 100 in FIG. 2D. On the other hand, in FIG. 4D, an image-forming area may be restricted to the right part.

Figure 5:
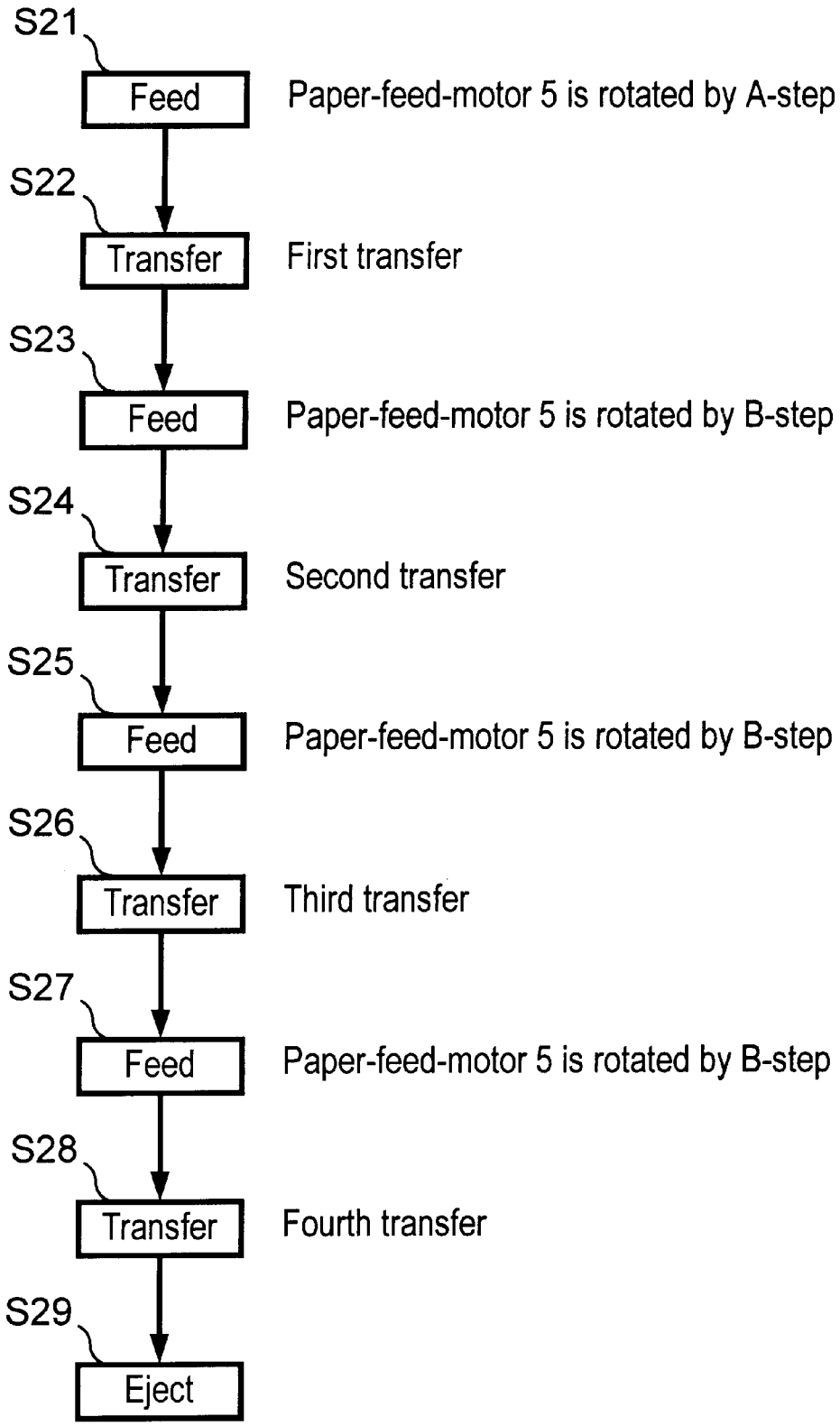
FIG. 5 is a flow chart showing the operation of a paper-feed control unit of a conventional image-forming apparatus.
Figure 6:
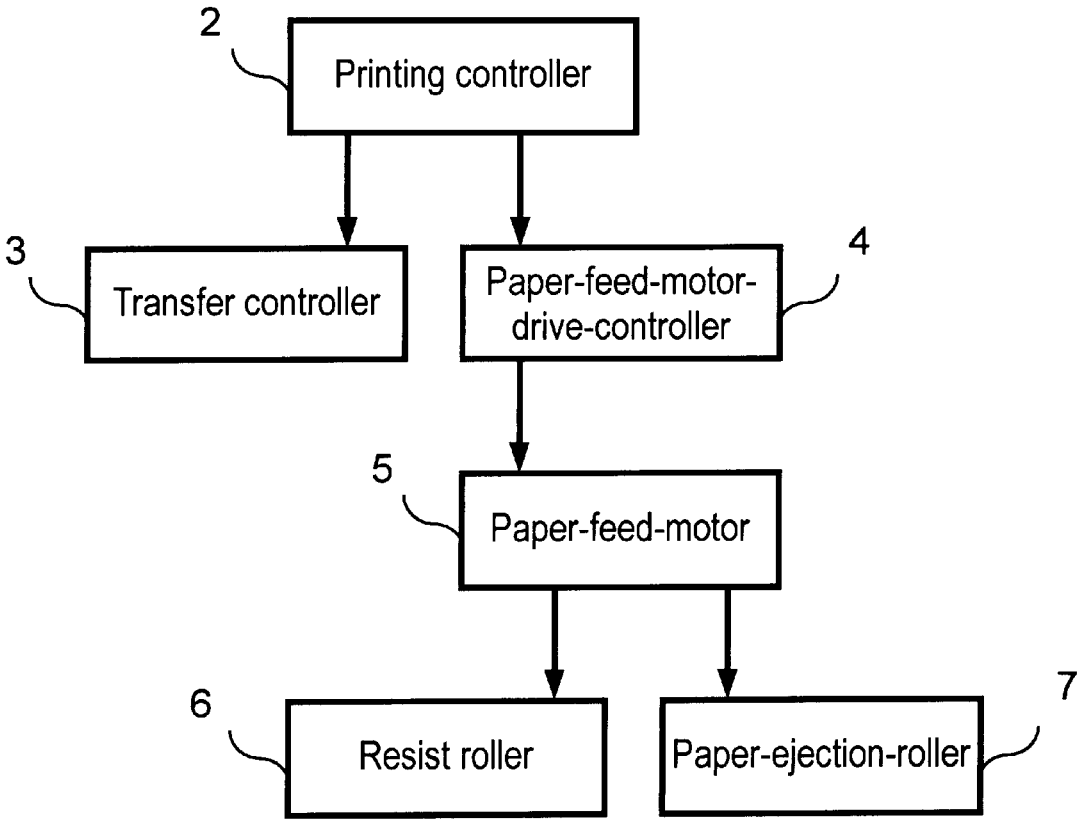
FIG. 6 is a block diagram showing a paper-feed control unit of a conventional image-forming apparatus.

If printing controller 2 judges the paper size to be other than, for example, A4 size at step S7, printing controller 2 may detect the paper size to be, for example, letter size (S11 in FIG. 5). If the paper size is determined to be a letter size, paper-feed-motor-drive-controller 4 rotates paper-feed-motor 5 by a D-step (S12 in FIG. 3), which is set in substantially the same manner as in the case of A4 described above. Then, a forth transfer may be performed (S13 in FIG. 3) on a fourth printing area (a final printing area) W. In this case as well, a separation dimensions of FIG. 2 and FIG. 4 are related by LS<LL. After final printing, the printing paper may be ejected (S14 in FIG. 3).

In the case where the paper size is determined to be other than letter size, for example at step S11 in FIG. 3, substantially the same operation as S8 through S10, labeled S12 through S14, may performed corresponding to the paper size.

In this exemplary embodiment, orthogonal printing type is described. The present invention, however, is not restricted to this type of printing, but is applicable to various a paper-feed control units of parallel-transfer-type image-forming apparatus in which the paper-feed may be performed by a predetermined dimension. The present invention may also be applicable to serial print type printers such as ink-jet printer, etc.

As described above, after performing a predetermined number of paper-feeds (twice in this exemplary embodiment) of predetermined paper-feed-dimension B1, corresponding to a predetermined printing width on a sheet of printing paper, a final paper-feed may be performed such that back end 12*b* of the printing paper remains in contact with resist roller 6. Hence, separation dimension LS of this exemplary embodiment becomes narrower than a conventional separation dimension LL. In other words, the dimension (separation dimension LS) traversed by paper-ejection-roller may be made smaller in this exemplary embodiment than separation dimension LL in a conventional apparatus. Accordingly, a final paper-feed may be made precisely in this exemplary embodiment, by which quality deterioration of image transfer caused by dispersion of a paper-feed-dimension may be prevented.

Further, since paper-feed-motor-drive-controller 4 determines a paper-feed-dimension and a final-paper-feed-dimension based on a paper-size-signal may be fed by printing controller 2, precise paper-feed may be performed corresponding to the size of the printing paper 12. In particular, a precise final paper-feed may be performed. Accordingly, quality deterioration of image transfer due to dispersion of paper-feed-dimension may be prevented with a simple control structure.

In this exemplary embodiment, an example showing a paper-feed-dimension narrower than a predetermined dimension, after a plurality of paper-feeds of a predetermined dimension, is described.

The same results, however, may also be achievable when a plurality of paper-feeds of varying dimensions is performed.

While in the foregoing there have been described embodiments of the present invention, it should be understood by those skilled in the art that various modifications and changes can be made without departing from the true spirit and scope of the present invention.

What is claimed is:

1. A paper-feed controlled image-forming apparatus comprising:

a resist roller for feeding a sheet of printing paper;

a paper-ejection-roller disposed at a downstream side of said resist roller;

image-forming means disposed between said resist roller and said paper-ejection-roller for forming an image with a predetermined width;

a motor for rotating said resist roller and said paper-ejection-roller; and a motor-drive-control-means for controlling the drive of said motor and for performing a paper-feed of a width narrower than said predetermined width on said sheet of printing paper when a dimension of an upstream-side-printing-paper-area, on which the image has not yet been formed by said image-forming means, becomes narrower than said predetermined width, wherein a plurality of paper-feeds of said predetermined width and at least one paper-feed of the width narrower than said predetermined width is performed on said sheet of printing paper by said motor, and image-forming is performed by said image-forming means after each respective paper-feed of said sheet of printing paper for forming the image.

2. The paper-feed controlled image-forming apparatus of claim 1, wherein said motor-drive-control-means performs said at least one paper-feed of the width narrower than said predetermined width on said sheet of printing paper when a dimension from an upstream-side end of an image-forming area of said image-forming means to a back end of said sheet of printing paper becomes narrower than said predetermined width.

3. The paper-feed controlled image-forming apparatus of claim 1, wherein said motor-drive-control-means performs said at least one paper-feed of the width narrower than said predetermined width on said sheet of printing paper when a dimension from an upstream side end of an image-forming area of said image-forming means to a back end of said sheet of printing paper becomes narrower than said predetermined width after performing the plurality of paper-feeds of said predetermined width, and said image-forming means performs image-forming of a width corresponding to the respective paper-feed after the respective paper-feed.

4. The paper-feed controlled image-forming apparatus of claim 1, wherein said motor-drive-control-means performs the plurality of paper feed on said sheet of printing paper such that a back end of said sheet of printing paper remains in contact with said resist roller from which the back end of said sheet of printing paper leaves when a dimension from an upstream side end of an image-forming area of said image-forming means to the back end of said paper becomes narrower than said predetermined width after performing the plurality of paper-feeds of said predetermined width, and said image-forming means performs image-forming of a width corresponding to the respective paper feed after the respective paper-feed.

5. The paper-feed controlled image-forming apparatus of claim 1, wherein said motor-drive-control-means performs the plurality of paper feeds on said sheet of printing paper such that a back end of said sheet of printing paper remains in contact with said resist roller from which the back end of said sheet of paper leaves when performing a final paper-feed on said printing paper before said image-forming means performs final image-forming on said sheet of printing paper, and after performing the plurality of paper feeds of said predetermined width on said sheet of printing paper on which said image-forming means performs image-forming of said predetermined width after the respective paper-feed.

6. The paper-feed controlled image-forming apparatus of claim 5, further comprising paper-size-detection-means for detecting the size of said sheet printing paper and for sending a signal indicating the size of said sheet of printing paper to said motor-drive-control-means, wherein said motor-drive-control-means determines a final paper-feed-dimension of said sheet of printing paper based on the signal indicating the size of said sheet of printing paper and fed by said paper-size-detection-means.

7. The paper-feed controlled image-forming apparatus of claim 6, wherein an area on which image-forming is performed by said image-forming means is restricted when printing on said printing paper after the final paper-feed of said final paper-feed-dimension is performed.

8. The paper-feed controlled image-forming apparatus of claim 7, wherein a width of said restricted image-forming area is narrower than said predetermined width.

* * * * *